United States Patent [19]

Van Malderghem

[11] 3,941,307

[45] Mar. 2, 1976

[54] ENVELOPE ASSEMBLY

[75] Inventor: Edmund G. Van Malderghem, Lewiston, N.Y.

[73] Assignee: Moore Business Forms, Inc., Niagara Falls, N.Y.

[22] Filed: Aug. 8, 1974

[21] Appl. No.: 495,924

[52] U.S. Cl. ..... 229/69; 229/85

[51] Int. Cl.[2] ..... B65D 27/10

[58] Field of Search ..... 229/69, 85

[56] References Cited

UNITED STATES PATENTS

| | | | |
|---|---|---|---|
| 3,104,799 | 9/1963 | Steidinger | 229/69 |
| 3,419,286 | 12/1968 | Noonan et al. | 229/69 X |
| 3,554,438 | 1/1971 | Van Malderghem | 229/69 |

*Primary Examiner*—William Price
*Assistant Examiner*—Stephen P. Garbe
*Attorney, Agent, or Firm*—Watson, Cole, Grindle & Watson

[57] ABSTRACT

An envelope assembly of a succession of envelopes each includes a front and back panel and extractable insert material contained therein, the insert material comprising a top-opening return mailer envelope connected to a portion of the envelope by means of a panel forming a portion or chip of the return envelope which is separable therefrom, and which is retained with the envelope upon extraction of the insert. As an alternative, the chip of the return envelope is connected to an insert sheet within each envelope.

5 Claims, 9 Drawing Figures

ENVELOPE ASSEMBLY

This invention relates generally to an envelope assembly, and more particularly to such an assembly of interconnected sealed envelopes having return envelopes with a connected flap contained therein which, after extraction, avoids accidental removal of the connected flap.

In the corresponding assembly of interconnected sealed envelopes of the type disclosed by U.S. Pat. No. 3,554,438, commonly owned herewith, insert material comprising a top opening return mailer envelope is shown in FIGS. 17 and 18 thereof. Top and back panels 54*x* and 55*x* are secured together along three sides and a top glue flap on the back panel is folded over and secured to the front face of the top panel upon extraction of the return mailer after waste chip 54*e* is removed and discarded. One of the problems with such an assembly is that many recipients of this type return mailer, upon extraction thereof, tend to remove not only the waste chip but also the rewettable glue flap. The return envelope is therefore left unsealable.

This problem is substantially eliminated by the present invention. The return mailer envelope is connected to a portion of the sealed envelope by means of this waste chip so that, upon extraction of the insert material, the waste chip is retained within the sealed envelope eliminating the need for subsequently removing same before top sealing of the return mailer as heretofore required. This is an object of the present invention.

Another object is to provide an envelope assembly of interconnected sealed envelopes each having insert material therein in the form of a return mailer envelope having an opening along one edge, with one of the upper or lower panels of the return envelope having a sealable flap for closing over the other panel, a separable portion on this other panel serving to connect the return mailer with the sealed envelope, and being retained with the sealed envelope upon extraction of the insert.

A further object of this invention is to provide such an envelope assembly wherein the insert material extends into a removable tear strip provided along one edge of the envelope, the envelope opening lying perpendicular to such edge so that the return mailer envelope is separated from the aforementioned portion along a line parallel to the direction of extraction.

A still further object of the invention is to provide an alternative envelope assembly of interconnected sealed envelopes each having insert material therein in the form of an insert sheet and a return mailer envelope having an opening along one edge, one of the panels of the return envelope having a sealable flap for closing over the other panel, a separable portion of this other panel serving to connect the return mailer with the adjacent insert sheet so that such portion remains connected with the insert when separated.

Other objects, advantages and novel features of the invention will become more apparent from the following detailed description of the invention when taken in conjunction with the accompanying drawings wherein.

Figure 1:
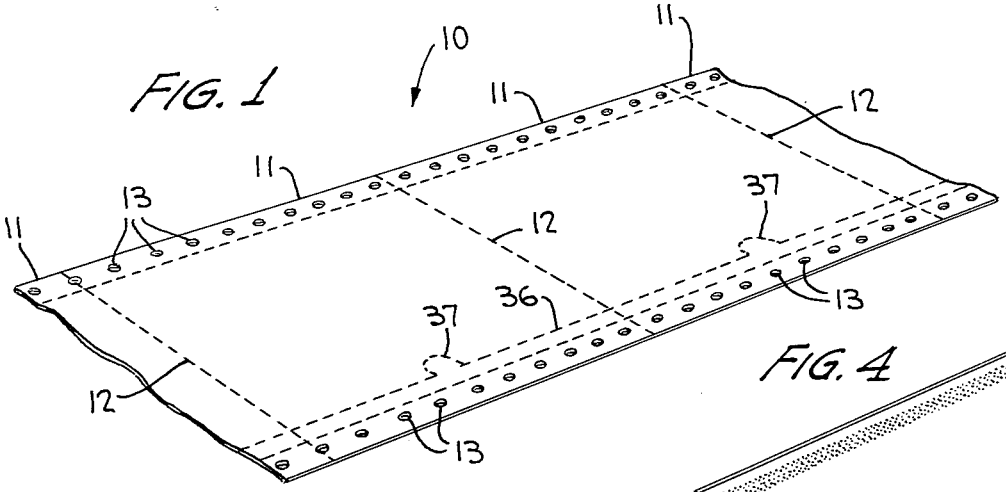
FIG. 1 is a fragmentary perspective view, on a slightly reduced scale, of an envelope assembly of interconnected sealed envelopes in accordance with the invention.

Turning now to the drawings wherein like reference characters refer to like and corresponding parts throughout the several views, an envelope assembly is generally shown at 10 in FIG. 1 as comprising a plurality of sealed envelopes 11 interconnected in succession along transverse tear lines 12. Feed holes 13 are provided along opposite sides of the assembly which is customary for feeding the assembly through a high speed printer, and through other web operations.

Figure 4:
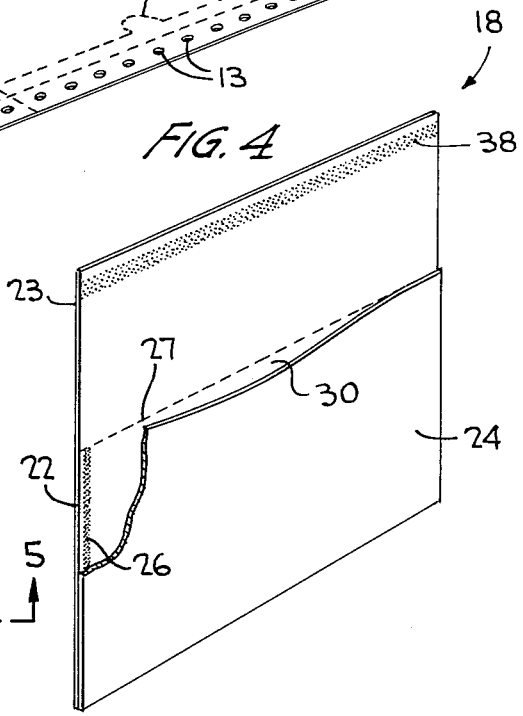
FIG. 4 is a perspective showing of the return mailer extracted from the FIG. 2 envelope.
Figure 2:
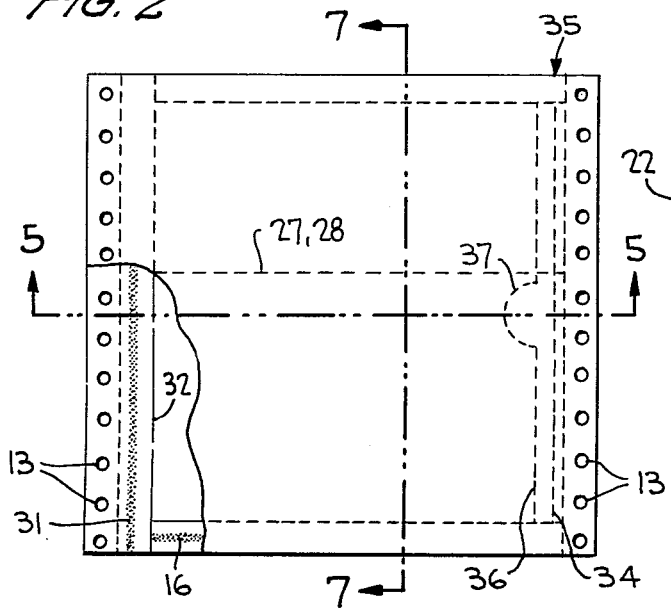
FIG. 2 is a plan view of one embodiment of an envelope of FIG. 1 shown partly broken away.
Figure 5:
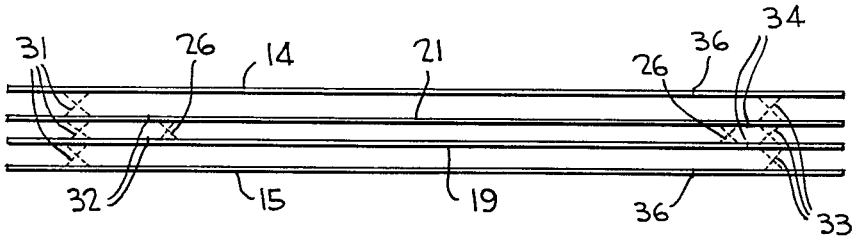
FIG. 5 is an expanded sectional view of the sealed envelope containing the return mailer taken along line 5—5 of FIG. 2.
Figure 6:
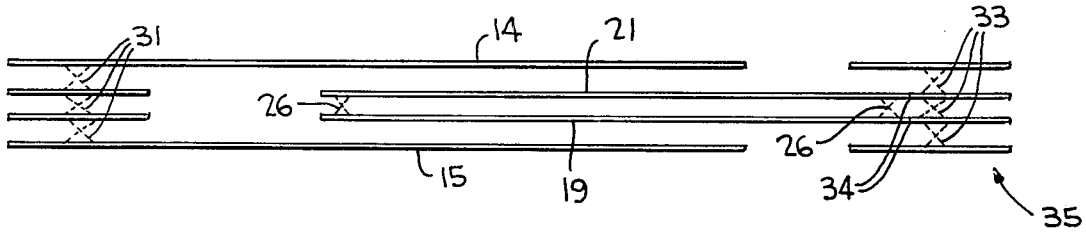
FIG. 6 is a view similar to FIG. 5 showing the process of extracting the return mailer insert.
Figure 7:
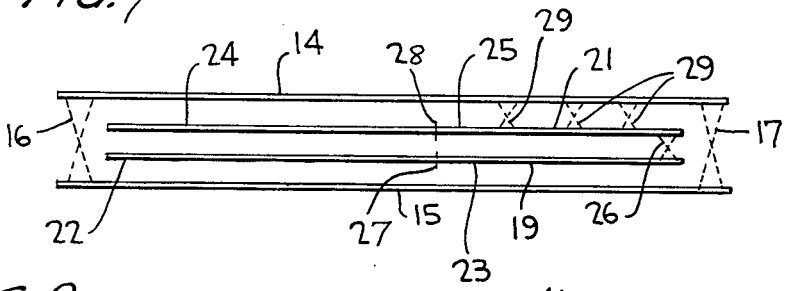
FIG. 7 is an expanded sectional view of the sealed envelope and its return mailer insert taken along line 7—7 of FIG. 2.

Each envelope comprises front and back panels 14 and 15, as shown in FIGS. 5–7, secured directly together along opposite ends by means of some suitable glue as at 16, 17. Each envelope contains insert material including a return mailer 18 as shown in FIG. 4. This insert comprises lower and upper panels 19 and 21 (FIG. 7) each divided into sections 22, 23 and 24, 25. As shown in FIG. 4, sections 22 and 24 are interconnected along a substantially U-shaped pattern paste configuration 26 so that the upper edges thereof are open as at 30. Portions 23 and 25 of respective panels 19 and 21 shown in FIG. 7 are of the same size and are superimposed over one another, with sections 22 and 23 being interconnected along a fold line 27. Sections 24 and 25 of panel 21 are interconnected along a tear line 28.

This return mailer envelope is connected by means of its chip or section 25 to one of the envelope panels as, for example, 15 shown in FIG. 7 with the use of adhesive 29. This may be spots or strips or pattern paste which is used in securing the mailer in place. As will be seen hereinafter, section 23 becomes a return envelope flap for sealing the mailer after extraction.

One side edge of panels 19 and 21 are secured together and to the front and back panels of the envelope by means of adhesive 31 (see FIG. 5). Weak tear lines having very keen ties are provided as at 32 for each of the return envelope panels 19 and 21.

As also seen in FIG. 5, the opposite sides of the return mailer panels are connected together and to the envelope front and back panels 14 and 15 by means of adhesive 33. Keen tear lines 34 having weak ties are likewise provided in panels 19 and 21 between adhesive patterns 26 and 33 so as to delimit that side end of the return mailer.

A tear strip 35 is provided for the envelope as defined by tear lines 36 provided in front and back panels 14 and 15 of the envelope. A thumb tab 37 extends inwardly of these tear lines to facilitate easier extraction of the insert.

Figure 3:
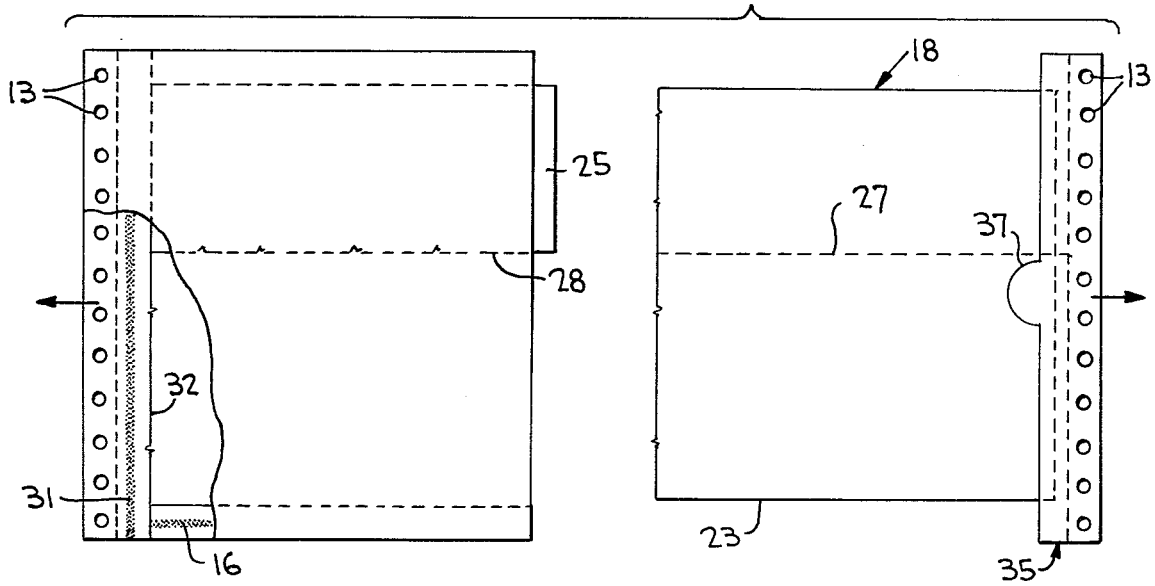
FIG. 3 is a plan view similar to FIG. 2 with the insert material contained within the envelope shown fully extracted therefrom.

After each sealed envelope 11 is burst from assembly 10 and thereafter mailed out, the recipient opens and extracts the return mailer by following instructions to grasp tear strip 35 with one hand over the thumb tabs, the other hand being placed outwardly of tear lines 32 in much the same manner as that described in the aforementioned patent. With a snapping action in a direction of the arrows of FIG. 3, return mailer 18 is extracted from the envelope as the connecting ties are broken along tear line 28. The keen ties at opposite sides of the return mailer are easily broken during the extraction process, tear strip 35 therefore being easily separated from the mailer. And, since the indicia imprinted on each envelope extends between opposite feed holes 13, opening 30 is parallel to such indicia and therefore defines a top opening. The waste chip or portion 25 of the return mailer construction is retained with the envelope after extraction so that the recipient is not required to remove this waste chip after extraction of the return mailer as before. With such a construction, the recipient then merely folds flap 23 down over the outer surface of section 24 after adhesive strip 38 is rewetted.

Figure 9:
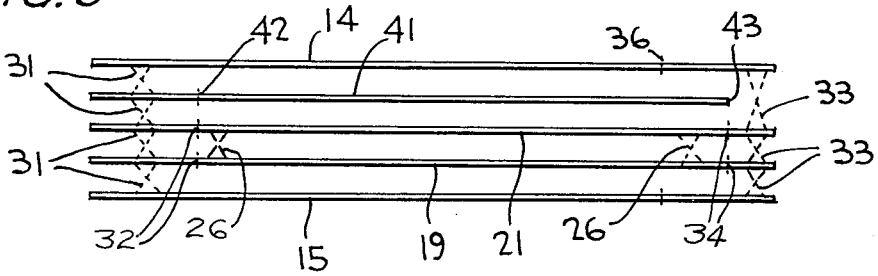
FIG. 9 is a view similar to FIG. 5 of the other embodiment.

In addition to a return mailer, the sealed envelope of the FIGS. 2–7 embodiment may contain one or more insert sheets 41 as shown in FIG. 9 connected to the envelope along at least one end thereof by a line 42 of perforations. End 43 of the insert may be spaced inwardly of adhesive strip 33 which interconnects panel 21 of the return envelope 18 with envelope panel 14. During the extraction process, similarly as in FIG. 6, both the insert sheet and the return mailer envelope are extracted together whereafter the insert sheet may be stuffed within the return envelope before mailing.

Figure 8:
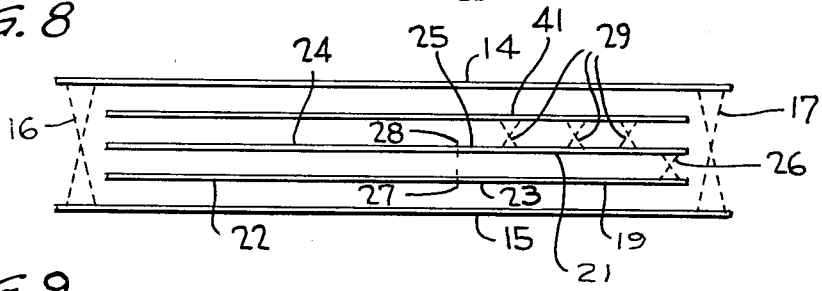
FIG. 8 is a view similar to FIG. 7 showing another embodiment of a sealed envelope according to the invention.

In the other embodiment of the invention, the return mailer is connected to insert sheet 41 rather than to one of the sealed envelope plies. As shown in FIG. 8, sections 22 and 23 are interconnected along fold line 27, and sections 24 and 25 are interconnected along tear line 28. The waste chip or section 25 connects the return mailer with insert 41 by means of adhesive 29. Otherwise, the envelope assembly construction of FIG. 8 is the same as in the first embodiment.

Extraction of insert 41 and the return mailer is the same as that shown in FIG. 6 with the addition of an insert sheet therein. However, waste chip 25 is removed along with the insert material upon extraction, rather than being retained with the sealed envelope as before. Insert sheet 41 is then merely separated from return mailer 18 along line 28, and is stuffed therewithin or retained by the recipient as the forms system design requires.

From the foregoing, it can be seen that a simple and economical yet highly effective return mailer has been devised wherein its waste chip normally provided in such constructions is retained either with the sealed envelope or with an insert sheet upon extraction thereof. Any accidental removal of flap 23 along with the waste chip is therefore avoided since the return mailer is either fully in a condition for mailing immediately upon its extraction without the need for removal of any portion thereof, or is readied for return mailing by simply separating it from its connected insert sheet.

Obviously, many modifications and variations of the invention are made possible in the light of the above teachings as, for example, a top or bottom opening return mailer. It is therefore to be understood that within the scope of the appended claims the invention may be practiced otherwise than as specifically described.

What is claimed is:

1. An envelope assembly formed of a continuous web having spaced transverse lines of weakening defining a succession of interconnected sealed envelopes, comprising: front and back panels, and insert material within each sealed envelope; said insert material comprising interconnected upper and lower panels forming a return envelope having an opening along one edge thereof, one of said return envelope panels being separable along a keen line of weakening provided therealong, the other of said return envelope panels having a flap foldable along a fold line provided thereon; attaching means connecting a portion of said insert material in each said sealed envelope with said sealed envelope, said portion comprising a section of said one panel which is superimposed over said flap and which is separable along said keen line of weakening; and a tear strip on each said sealed envelope for opening said sealed envelope and freeing said return envelope from said sealed envelope, said section of said return envelope being retained with said sealed envelope upon the freeing of said return envelope from said sealed envelope.

2. The envelope assembly according to claim 1, wherein said tear strip is located along one end of said sealed envelope, and said keen line of weakening is disposed perpendicular to said tear strip.

3. The envelope assembly according to claim 2, wherein said extends along said section return envelope between opposite end edges thereof.

4. The envelope assembly according to claim 2, wherein said tear strip is superimposed on one end of said return envelope and the opposite end of said return envelope lies inwardly of the opposite end of said sealed envelope to facilitate separation of said return envelope along said keen line of weakening as said opposite end of said sealed envelope and said tearstrip are moved away from one another.

5. An envelope assembly formed of a continuous web having spaced transverse lines of weakening defining a succession of interconnected sealed envelopes, comprising: front and back panels, and insert material within each sealed envelope; said insert material comprising interconnected upper and lower panels forming a return envelope having an opening along one edge thereof, one of said return envelope panels being separable along a keen line of weakening provided therealong, the other of said return envelope panels having a flap foldable along a fold line provided thereon; said insert material further comprising an insert sheet removably connected with said sealed envelope along at least one edge thereof; attaching means connecting a portion of said return envelope in each said sealed envelope with said insert sheet therein, said portion comprising a section of said one panel which is superimposed over said flap and which is separable along said keen line of weakening; and a tear strip on each sealed envelope for opening said sealed envelope and freeing said insert material from said sealed envelope, said return envelope and said insert sheet thereby together being freed from said sealed envelope, and said return envelope being separable from said insert sheet along said keen lines of weakening whereby said section is retained with said insert sheet upon separation of said return envelope and said insert sheet.

* * * * *

Disclaimer 3,941,307.—*Edmund G. Van Malderghem*, Lewiston, N.Y. ENVELOPE ASSEMBLY. Patent dated Mar. 2, 1976. Disclaimer filed May 23, 1978, by the assignee, *Moore Business Forms, Inc.*

Hereby enters this disclaimer to claims 1, 2 and 3 of said patent.

[*Official Gazette July 11, 1978.*]